US008052070B2

(12) United States Patent
Bakken

(10) Patent No.: US 8,052,070 B2
(45) Date of Patent: Nov. 8, 2011

(54) APPARATUS FOR APPLYING MARKINGS ON A ROAD SURFACE

(75) Inventor: Erik Bakken, Trysil (NO)

(73) Assignee: Trysil Maskin AS, Nybergsund (NO)

( * ) Notice: Subject to any disclaimer, the term of this patent is extended or adjusted under 35 U.S.C. 154(b) by 378 days.

(21) Appl. No.: 12/227,786

(22) PCT Filed: May 31, 2007

(86) PCT No.: PCT/NO2007/000187

§ 371 (c)(1),
(2), (4) Date: Dec. 19, 2008

(87) PCT Pub. No.: WO2008/010720

PCT Pub. Date: Jan. 24, 2008

(65) Prior Publication Data

US 2009/0145979 A1 Jun. 11, 2009

(30) Foreign Application Priority Data

Jun. 2, 2006 (NO) ..... 20062544

(51) Int. Cl.
*B05B 1/28* (2006.01)

(52) U.S. Cl. ..... 239/150; 239/146; 239/581; 239/69; 404/93; 404/94

(58) Field of Classification Search ..... 239/146, 239/150, 151, 569, 581, 69; 404/93, 94
See application file for complete search history.

(56) References Cited

U.S. PATENT DOCUMENTS

| | | | | |
|---|---|---|---|---|
| 4,624,602 | A * | 11/1986 | Kieffer et al. | 239/150 |
| 5,054,959 | A * | 10/1991 | Wilson et al. | 239/150 |
| 6,227,454 | B1 | 5/2001 | Wolf et al. | |
| 6,413,012 | B1 * | 7/2002 | Jones | 404/94 |

FOREIGN PATENT DOCUMENTS

| | | |
|---|---|---|
| DE | 8708560.7 | 9/1987 |
| NO | 316123 | 12/2002 |

* cited by examiner

*Primary Examiner* — Steven J Ganey
(74) *Attorney, Agent, or Firm* — Dennison, Schultz & MacDonald

(57) ABSTRACT

Apparatus for depositing a flowable substance as marking on road surfaces, and the like, comprising a container for the flowable substance which is conducted through a valve with a series of computer controlled, close adjacently arranged valve elements which can be activated individually with a series of activating members with connecting elements to the individual valve elements. The apparatus comprises a way of varying as an assembly the geometry of the movement of activating members of the valve members. The connecting elements are linked to a longitudinally extending member with an eccentric mechanism to regulate the active length of the connection between the activating member and the valve member for each of a plurality of valve members.

6 Claims, 2 Drawing Sheets

APPARATUS FOR APPLYING MARKINGS ON A ROAD SURFACE

Figure 1:
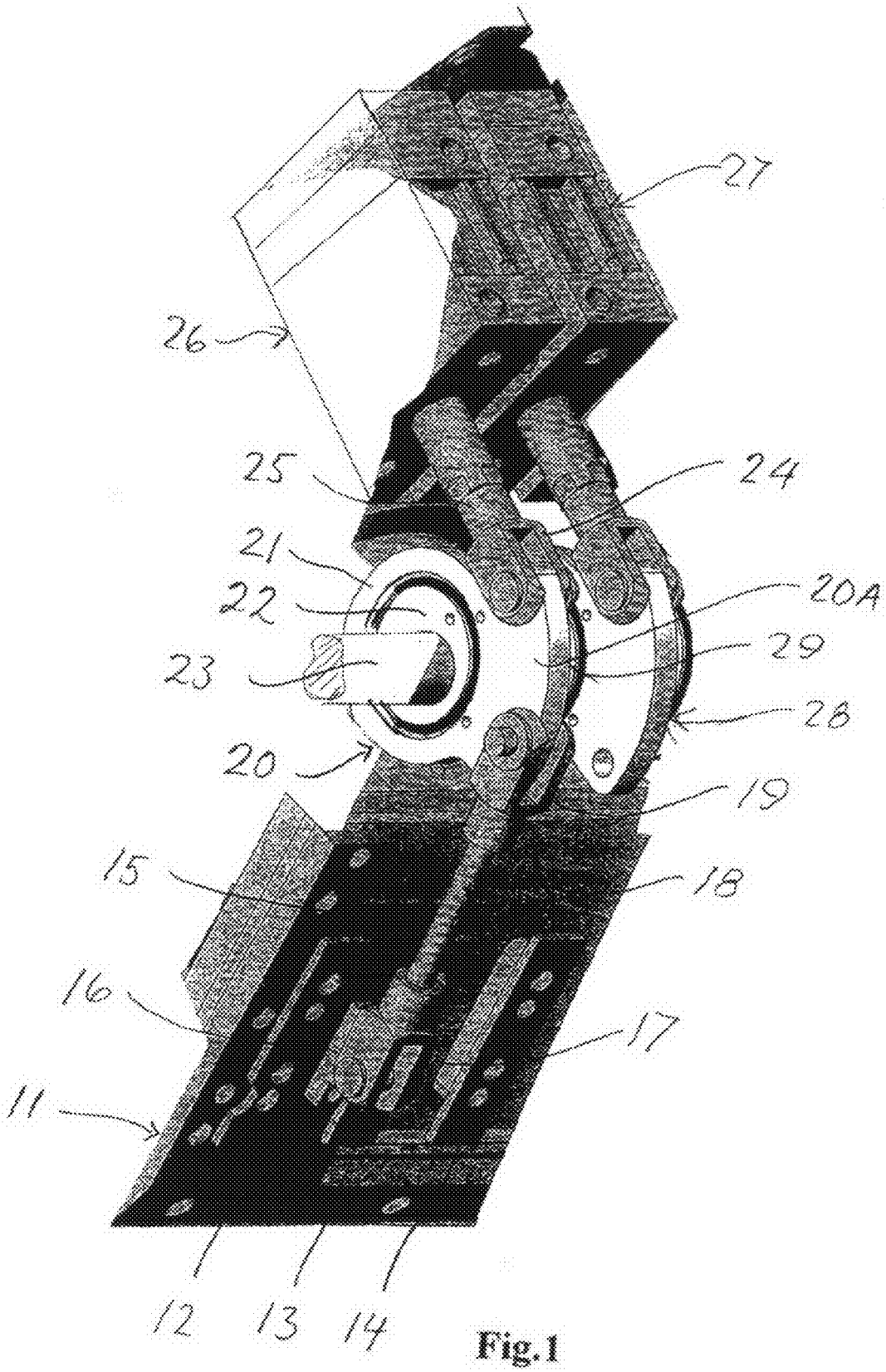

This application is a 371 of PCT/NO2007/000187 filed on May 31, 2007.

The invention relates to an apparatus as stated in the introductory part of claim 1, for applying a flowable substance for a continuous or distributed marking coating on road surfaces, parking lots, turn-offs etc.

BACKGROUND

From Norwegian patent 311733 (Trysil Maskin) such an apparatus provided for mounting at a vehicle, with a pressurized container receiving flowable substance from a storage container is known. The substance is conducted through a valve means with a throttle member facing the ground, with the axis perpendicular to the direction of movement. This valve means is connected to a secondary valve means arranged with the axis parallel to the outlet slot of a cylindrical bushing member, which connects an inlet slot from the pressurized container with the outlet slot at the valve means. This apparatus is operating satisfying at normal deposition of longitudinal stripes on road surface, but it is not suitable for deposition of design and not for controlled deposition of markings with improved reflexive properties for wet markings and for substances needing heating.

From Norwegian patent 316123 (Trysil Maskin) an apparatus is known, which is suitable for mounting on or integrating in a vehicle, with a pressurized container receiving a flowable substance from a storage container, which substance is conducted through a valve means with a series of computer controlled, adjacent valve members being individually controllable. Although this apparatus allows the deposition of designed markings, the means for the control of the valve openings is not operating satisfying. A further drawback of this prior art apparatus is the risk for clogging of the valve opening, lacking means for managing this problem.

OBJECTS

The invention has two important objects:

- to enable the control of all valve openings simultaneously, preferably by remote control,
- to vary the thickness of the markings during deposition, e.g. for depositing a thicker marking in curves and other areas with large wear, or for changing between different thicknesses of the markings in other connections, and
- to simplify the removal of contaminating element, clogs, and other particles which can create clogging. These functions should be achievable while maintaining the qualities of prior art equipment. The disposer should have least possible wearable parts, and wearable parts should be easily renewable and have a reasonable price.

THE INVENTION

The invention is stated in claim 1. Further features of the invention are stated in the subclaims.

The apparatus according to the invention enables a better control of the disposing of the markings than at prior art equipment. It can be used with more flexibility and for depositing markings with varying thickness. And it enables the removal of contaminations, clogs etc.

Further details regarding design, function and effects of the invention is described in more details in the following, with reference to the drawings.

EXAMPLE

The invention is illustrated in the drawings, wherein

Figure 2:
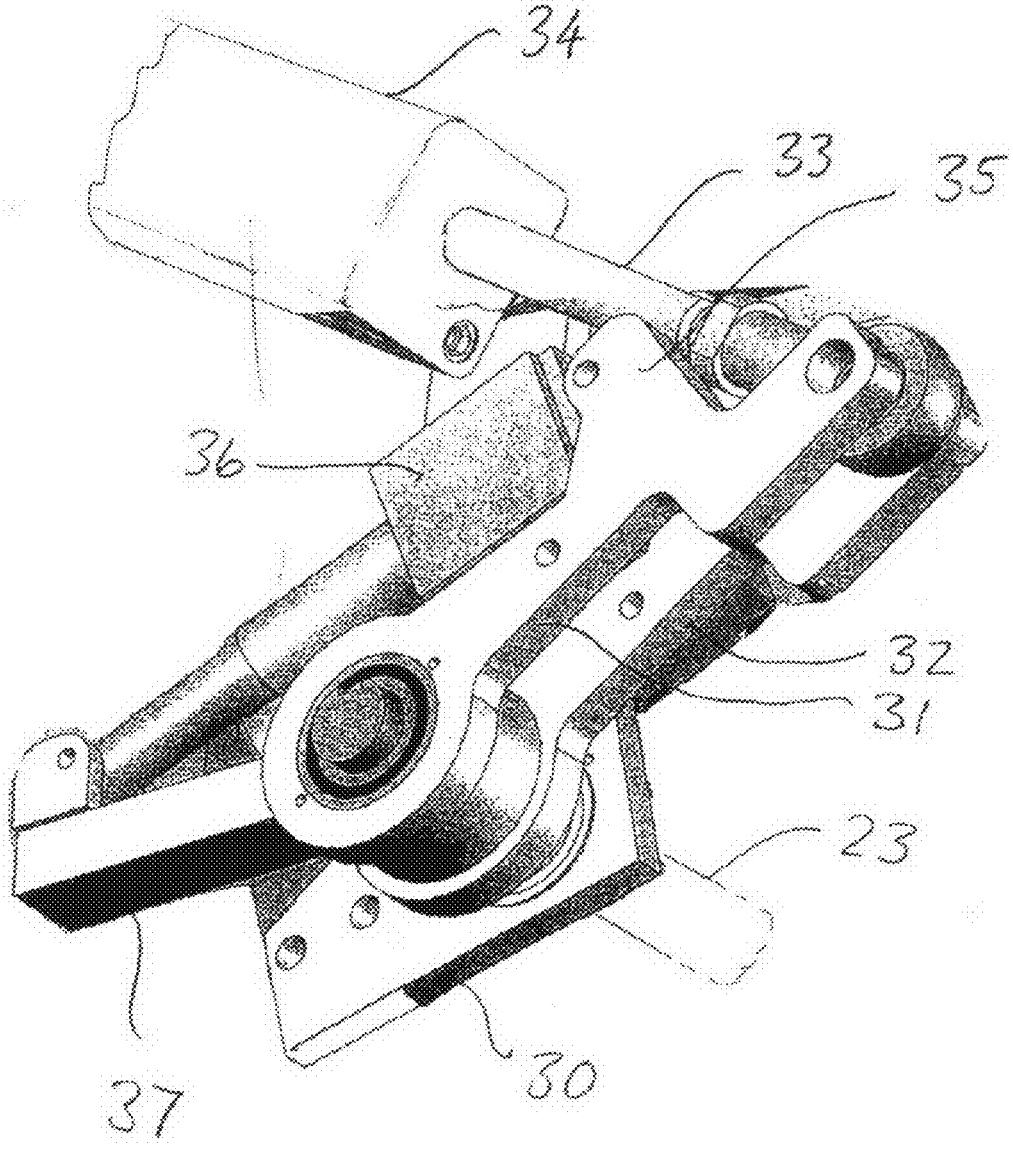

FIG. 1 shows a perspective view of an embodiment of the invention with a section through a valve system with two valve activators, and corresponding transfer elements to the valves, with an excenter mechanism, while FIG. 2 shows a corresponding perspective view of an embodiment of an activating mechanism for the excenter mechanism and for the cleansing.

In FIG. 1 a carrying rail 11 with three guiding rails 12, 13, 14 for control valve bodies is shown, only one control valve body 15 being shown. The control valve body 15 has a centrally located bracket 16 with openings for attaching a fork 17 at the end of a rod 18. At its upper end, the rod 18 carries a fork 19 being linked to a pivoting dish 20. The pivoting dish 20 has a central part 21 rotatable journalled on an excentric dish 22 carried by an activating rod 23 designed as a shaft. The pivoting dish 20 protrudes from the central part 21 by a radial protrusion 20A which has an attachment both for a fork 24 at the end of a piston rod 25 on an activator cylinder 26. A further activator cylinder 27 with a connected pivoting dish 28 on an excentric dish 29 is shown in the drawing. The excenter distance may be 5-10 mm, e.g. 8 millimeter.

The length of the carrying rail 11 and the number of control valve bodies will depend on the kind of use, normally depositing marking stripes on roadways and streets.

The use of the activator cylinders 26, 27 is known from Norwegian patent specification 316123. The function of the pivoting dishes 20 and 28 on the excentric dishes 22, 29 is described in the following.

In FIG. 2 it is shown how one end of the activating rod 23 is pivotably journalled on a carrier dish 30 attached to the main structure of the marking apparatus. The carrying dish 30 may be arranged close to the control valve body 15. On the external side of the carrying dish 30, the activator rod has pivotably journalled two arms 31, 32, being of equal length and being parallel, both being linked to a piston rod 33 of a pneumatic cylinder 34. The pneumatic cylinder 34 is connected to the carrying structure of the apparatus.

On the upper side of the arms 31, 32, two brackets 35 are protruding, between which an activator 36, e.g. an electric linear motor, is linked. It may comprise an encoder to monitor the valve opening during operation. The other end of the activator 36 is linked to a crank arm 37 rigidly connected to the activating rod 23.

At the operation of the activator 36, the activating rod 23 will be pivoted to pivot the excentrical dishes 22, 29 and displace the pivoting dish radially outward or inward. Thus the geometry of the transfer system from the activator cylinders 26, 27 to the attached valves is changed. This again will provide changes in the valve opening created when the activating cylinders 26, 27 is pressurized.

When supplying pulses of compressed air with suitable duration to the pneumatic cylinder 34, the activating rod 23 will pivot between its extremes and provide repeated openings and closings of the valves. Thus residues and clogs can be released from clogged valve openings.

At an alternative embodiment, the eccentric dishes 29 introduced in the linkage between the activating cylinders 25, 26 and the control valve bodies 15 are replaced by a corresponding mechanism at the support of the activating cylinders 25, 26. The excentric mechanism may be replaced by alternative transfer means.

What is claimed is:

1. Apparatus for mounting on or integrating in a vehicle for depositing a flowable substance as continuous or distributed markings on road surfaces, with a container for the flowable substance, which substance is conducted through a valve means with a series of computer controlled, close adjacently arranged plurality of valve elements on a carrier which can be operated individually with a series of activating members with connecting elements to the individual valve elements, wherein said apparatus comprises an eccentric mechanism as an assembly a geometry of the movement of the activating members of the plurality of valve elements, the eccentric mechanism extending along a row of the plurality of valve elements being provided to regulate an active length of a connection between each activating member and each valve member for the plurality of valve elements.

2. Apparatus according to claim 1, wherein the eccentric mechanism comprises an eccentric dish integrated in the connecting chain for each valve element, and that connecting elements for each valve element are carried by an eccentric dish, said eccentric dishes being journalled on a common shaft with an activator for pivoting the common shaft.

3. Apparatus according to claim 2, comprising a pneumatic cylinder, being connected to the common shaft through a double crank arm.

4. Apparatus according to claim 3, wherein the double crank arm is pivotably journalled on the common shaft and that a second crank arm being pivotable relative to said double crank arm and which is connected to said double crank arm through the activator.

5. Apparatus according to claim 4, wherein the activator is linked between the end of the second crank arm and a protruding bracket on said double crank arm.

6. Apparatus according to claim 1, wherein the carrier of the plurality of valve elements is connected to a pivoting rod provided to adjust a geometry of the carrier, with the eccentric mechanism.

* * * * *